US008992396B2

(12) United States Patent
Wang

(10) Patent No.: US 8,992,396 B2
(45) Date of Patent: Mar. 31, 2015

(54) ADJUSTABLE DUMBBELL

(75) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 332 days.

(21) Appl. No.: 13/559,687

(22) Filed: Jul. 27, 2012

(65) Prior Publication Data

US 2014/0031177 A1 Jan. 30, 2014

(51) Int. Cl.
*A63B 21/072* (2006.01)
*A63B 21/075* (2006.01)

(52) U.S. Cl.
CPC ..... *A63B 21/075* (2013.01); *A63B 21/0726* (2013.01)
USPC ..... 482/107; 482/106; 482/108

(58) Field of Classification Search
CPC ..... A63B 21/0728; A63B 21/075; A63B 21/00065; A63B 21/0726; A63B 21/072; A63B 2021/0623; A63B 21/0724
USPC ..... 482/92–109, 908
See application file for complete search history.

(56) References Cited

U.S. PATENT DOCUMENTS 4,482,151 A * 11/1984 Zwilling ..... 482/106
5,518,478 A * 5/1996 Liang ..... 482/108
5,607,379 A * 3/1997 Scott ..... 482/107
5,839,997 A 11/1998 Roth et al.
6,416,446 B1 7/2002 Krull
6,461,282 B1 * 10/2002 Fenelon ..... 482/106
6,656,093 B2 12/2003 Chen
6,669,606 B2 12/2003 Krull
6,719,674 B2 4/2004 Krull
6,733,424 B2 5/2004 Krull
7,137,931 B2 11/2006 Liu
7,153,243 B1 12/2006 Krull
7,172,536 B2 * 2/2007 Liu ..... 482/108
7,223,214 B2 5/2007 Chen
7,485,077 B2 2/2009 Chen
7,614,982 B2 * 11/2009 Crawford et al. ..... 482/107
7,731,641 B1 6/2010 Chen
8,025,613 B1 * 9/2011 Wang ..... 482/107
8,790,223 B2 * 7/2014 Wang ..... 482/106

* cited by examiner

*Primary Examiner* — Oren Ginsberg
*Assistant Examiner* — Joshua Lee
(74) *Attorney, Agent, or Firm* — Charles E. Baxley

(57) ABSTRACT

An adjustable barbell or dumbbell or exercise device includes a handle having an end member, a spring biased latching element engaged in the end member, a weight member attached onto the end member and having an aperture for engaging with the spring biased latching element and for anchoring the weight member to the end member, a button is slidably engaged in the weight member for selectively depressing the spring biased latching element into the end member and for disengaging the spring biased latching element from the weight member and for allowing the weight member to be engaged onto and disengaged from the end member of the handle. The other outer weight members are attachable onto the weight member in series.

15 Claims, 10 Drawing Sheets

ADJUSTABLE DUMBBELL

BACKGROUND OF THE INVENTION

1. Field of the Invention

The present invention relates to an adjustable exercise device or dumbbell or the like, and more particularly to an adjustable exercise device or dumbbell including an improved compact structure for allowing the weight members to be easily and quickly and readily and adjustably attached to or disengaged from the weight carrier or handle and for allowing the adjustable dumbbell to be easily operated by the user.

2. Description of the Prior Art

Typical exercise devices or barbells or dumbbells comprise a handle to be grasped or held by the user, and a number of weight plates to be attached onto the ends of the handle for weight lifting or exercising purposes, or for exercising or training the upper muscle groups or the lower muscle groups of the user.

For example, U.S. Pat. No. 5,839,997 to Roth et al., U.S. Pat. No. 6,416,446 to Krull, U.S. Pat. No. 6,656,093 to Chen, U.S. Pat. No. 6,669,606 to Krull, U.S. Pat. No. 6,719,674 to Krull, U.S. Pat. No. 6,733,424 to Krull, U.S. Pat. No. 7,137,931 to Liu, U.S. Pat. No. 7,153,243 to Krull, U.S. Pat. No. 7,172,536 to Liu, U.S. Pat. No. 7,223,214 to Chen, U.S. Pat. No. 7,485,077 to Chen, and U.S. Pat. No. 8,025,613 to Wang disclose several typical adjustable dumbbells each comprising a number of weight plates or weight members selectively or adjustably attaching or mounting onto the handle shaft or handle bar that is provided for being held or grasped by the users to train the upper muscle groups or the lower muscle groups of the user, and a latch device attached onto the handle and/or the weighted plates for selectively or adjustably mounting or securing selected or different number of the weighted plates on the ends of the handle and for exercising or training the upper muscle groups or the lower muscle groups of the user.

However, a supporting base is further required to be provided for stably supporting the weight plates or weight members in place, and the latch device is required to be moved relative to the handle or the weight plates or weight members or actuated to engage with the required or selected number of the weighted plates or weight members when the weight plates or weight members are supported on or in the supporting base, and before the handle and the weight plates or weight members may be lifted or moved away from the supporting base; i.e., the weight plates or weight members should be solidly and stably disposed and received and supported in the supporting base, and the latch device is required to be moved relative to the handle or the weight plates or weight members or actuated to engage with and to couple the required or selected number of the weighted plates or weight members to the handle before the handle and the weight plates or weight members may be lifted or moved away from the supporting base.

U.S. Pat. No. 7,731,641 to Chen discloses a further typical adjustable dumbbell comprising a series of weighted plates to be attached onto the ends of the handle, and a lock nut should be attached onto the ends of the handle for selectively or adjustably mounting or securing or anchoring the weighted plates on the ends of the handle.

However, it takes a long time to thread and unthread the lock nuts from the handle in order to attach or mount the required or selected number of the weight plates or weight members onto or from the ends of the handle.

U.S. Pat. No. 5,518,478 to Liang discloses a still further typical adjustable dumbbell comprising a series of weighted plates to be attached onto the ends of the handle, and to be engaged onto one another.

However, the smallest weighted plates should be attached or mounted or secured onto the ends of the handle with a threaded engagement, and it takes a long time to thread and unthread the smallest weighted plates to and from the ends of the handle, in addition, the smallest weighted plates may not be solidly and stably secured or locked or retained to the ends of the handle and may have a good chance to be disengaged from the ends of the handle inadvertently while in use, and the falling weighted plates may have a good chance to hurt the users. Furthermore, the weighted plates are only anchored or retained to each other with spring biased projections or detents or balls, and the weighted plates also may have a good chance to be disengaged from each other inadvertently while in use; i.e., the weighted plates may not be solidly and stably secured or locked or retained to the ends of the handle and/or secured or locked or retained together and may have a good chance to be disengaged from each other.

The present invention has arisen to mitigate and/or obviate the afore-described disadvantages of the conventional adjustable dumbbells.

SUMMARY OF THE INVENTION

The primary objective of the present invention is to provide an adjustable exercise device or dumbbell including an improved compact structure for allowing the weight members to be easily and quickly and readily and adjustably attached to or disengaged from the weight carrier or handle and for allowing the adjustable dumbbell to be easily operated by the users.

The other objective of the present invention is to provide an adjustable exercise device or dumbbell including an improved compact structure for allowing the weight members to be easily and quickly and readily and adjustably attached to or disengaged from the weight carrier or handle without supporting the weight members in a supporting base.

The further objective of the present invention is to provide an adjustable exercise device or dumbbell including an improved compact structure for allowing the weight members to be received and accommodated and engaged with each other to a compact folding or receiving or storing structure or configuration.

In accordance with one aspect of the invention, there is provided an adjustable exercise device comprising a handle including a first end member, a first spring biased latching element slidably received and engaged in the first end member of the handle, and selectively extendible out of the first end member of the handle, and including an inclined surface formed and provided on top thereof, a first base weight member including a chamber formed therein for receiving and engaging with the first end member of the handle and for allowing the first base weight member to be attached and engaged onto the first end member of the handle, and including an aperture formed in the first base weight member and communicating with the chamber of the first base weight member, and the first base weight member being contactable and engagable with the inclined surface of the first spring biased latching element for pressing the first spring biased latching element into the first end member of the handle and for allowing the first base weight member to be attached and engaged onto the first end member of the handle, and the first spring biased latching element being biased to engage into the aperture of the first base weight member when the first spring biased latching element is aligned with the aperture of the first base weight member, for anchoring and retaining the first base weight member to the first end member of the handle, and a first button slidably received and engaged in the first base weight member and aligned with the aperture of the first base weight member and the first spring biased latching element for selectively depressing the first spring biased latching element into the first end member of the handle, and for selectively disengaging the first spring biased latching element from the first base weight member and for allowing the first base weight member to be engaged onto and disengaged from the first end member of the handle.

The handle includes a recess formed in the first end member, and a plate engaged into the recess of the first end member, and the plate includes an orifice formed therein for slidably receiving and engaging with the first spring biased latching element. The handle includes a cavity formed in the first end member for receiving and engaging with a spring biasing member of the first spring biased latching element.

The plate includes a flange extended into the orifice of the plate, and the first spring biased latching element includes an outer peripheral rib for selectively engaging with the flange of the plate and for limiting the first spring biased latching element to slide and move relative to the plate and for preventing the first spring biased latching element from being disengaged from the plate and the first end member of the handle.

The handle includes a second end member, a second spring biased latching element slidably received and engaged in the second end member of the handle, and selectively extendible out of the second end member of the handle, and an inclined surface formed and provided on top of the second spring biased latching element, a second base weight member having a chamber formed therein for receiving and engaging with the second end member of the handle and for allowing the second base weight member to be attached and engaged onto the second end member of the handle, and having an aperture formed in the second base weight member and communicating with the chamber of the second base weight member, and the second base weight member is contactable and engagable with the inclined surface of the second spring biased latching element for pressing the second spring biased latching element into the second end member of the handle and for allowing the second base weight member to be attached and engaged onto the second end member of the handle, and the second spring biased latching element being biased to engage into the aperture of the second base weight member when the second spring biased latching element is aligned with the aperture of the second base weight member, for anchoring and retaining the second base weight member to the second end member of the handle, and a second button slidably received and engaged in the second base weight member and aligned with the aperture of the second base weight member and the second spring biased latching element for selectively depressing the second spring biased latching element into the second end member of the handle, and for selectively disengaging the second spring biased latching element from the second base weight member and for allowing the second base weight member to be engaged onto and disengaged from the second end member of the handle.

The handle includes a recess formed in the second end member, and a plate engaged into the recess of the second end member, and the plate includes an orifice formed therein for slidably receiving and engaging with the second spring biased latching element. The handle includes a cavity formed in the second end member for receiving and engaging with a spring biasing member of the second spring biased latching element.

The plate includes a flange extended into the orifice of the plate, and the second spring biased latching element includes an outer peripheral rib for selectively engaging with the flange of the plate and for limiting the second spring biased latching element to slide and move relative to the plate and for preventing the second spring biased latching element from being disengaged from the plate and the second end member of the handle.

The first base weight member includes a first spring biased catching element slidably received and engaged in the first base weight member, and selectively extendible out of the first base weight member, and includes an inclined surface formed and provided on top of the first spring biased catching element, an intermediate weight member includes a chamber formed therein for receiving and engaging with the first base weight member and for allowing the intermediate weight member to be attached and engaged onto the first base weight member, and includes an aperture formed in the intermediate weight member and communicating with the chamber of the intermediate weight member, and the intermediate weight member is contactable and engagable with the inclined surface of the first spring biased catching element for pressing the first spring biased catching element into the first base weight member and for allowing the intermediate weight member to be attached and engaged onto the first base weight member, and the first spring biased catching element is biased to engage into the aperture of the intermediate weight member when the first spring biased catching element is aligned with the aperture of the intermediate weight member for anchoring and retaining the intermediate weight member to the first base weight member.

The intermediate weight member includes a second button slidably received and engaged in the intermediate weight member and aligned with the aperture of the intermediate weight member and the first spring biased catching element for selectively depressing the first spring biased catching element into the first base weight member, and for selectively disengaging the first spring biased catching element from the intermediate weight member and for allowing the intermediate weight member to be engaged onto and disengaged from the first base weight member.

The intermediate weight member includes a compartment formed therein, a panel engaged into the compartment of the intermediate weight member and having a hole formed therein for slidably receiving and engaging with the second button.

The panel includes an inner peripheral flange extended into the hole thereof, and the second button includes an outer peripheral rib for selectively engaging with the peripheral flange the panel and for limiting the second button to slide and move relative to the panel and for preventing the second button from being disengaged from the panel and the intermediate weight member.

The intermediate weight member includes a second spring biased catching element slidably received and engaged in the intermediate weight member, and selectively extendible out of the intermediate weight member, and includes an inclined surface formed and provided on top of the second spring biased catching element, an outer weight member includes a chamber formed therein for receiving and engaging with the intermediate weight member and for allowing the outer weight member to be attached and engaged onto the intermediate weight member, and includes an aperture formed in the outer weight member and communicating with the chamber of the outer weight member, and the outer weight member is contactable and engagable with the inclined surface of the second spring biased catching element for pressing the second spring biased catching element into the intermediate weight member and for allowing the outer weight member to be attached and engaged onto the intermediate weight member, and the second spring biased catching element is biased to engage into the aperture of the outer weight member when the second spring biased catching element is aligned with the aperture of the outer weight member for anchoring and retaining the outer weight member to the intermediate weight member.

The outer weight member includes a third button slidably received and engaged in the outer weight member and aligned with the aperture of the outer weight member and the second spring biased catching element for selectively depressing the second spring biased catching element into the intermediate weight member, and for selectively disengaging the second spring biased catching element from the outer weight member and for allowing the outer weight member to be engaged onto and disengaged from the intermediate weight member.

The outer weight member includes a compartment formed therein, a panel engaged into the compartment of the outer weight member and having a hole for engaging with the third button. The panel includes an inner peripheral flange extended into the hole thereof, and the third button includes an outer peripheral rib for selectively engaging with the peripheral flange the panel and for limiting the third button to slide and move relative to the panel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
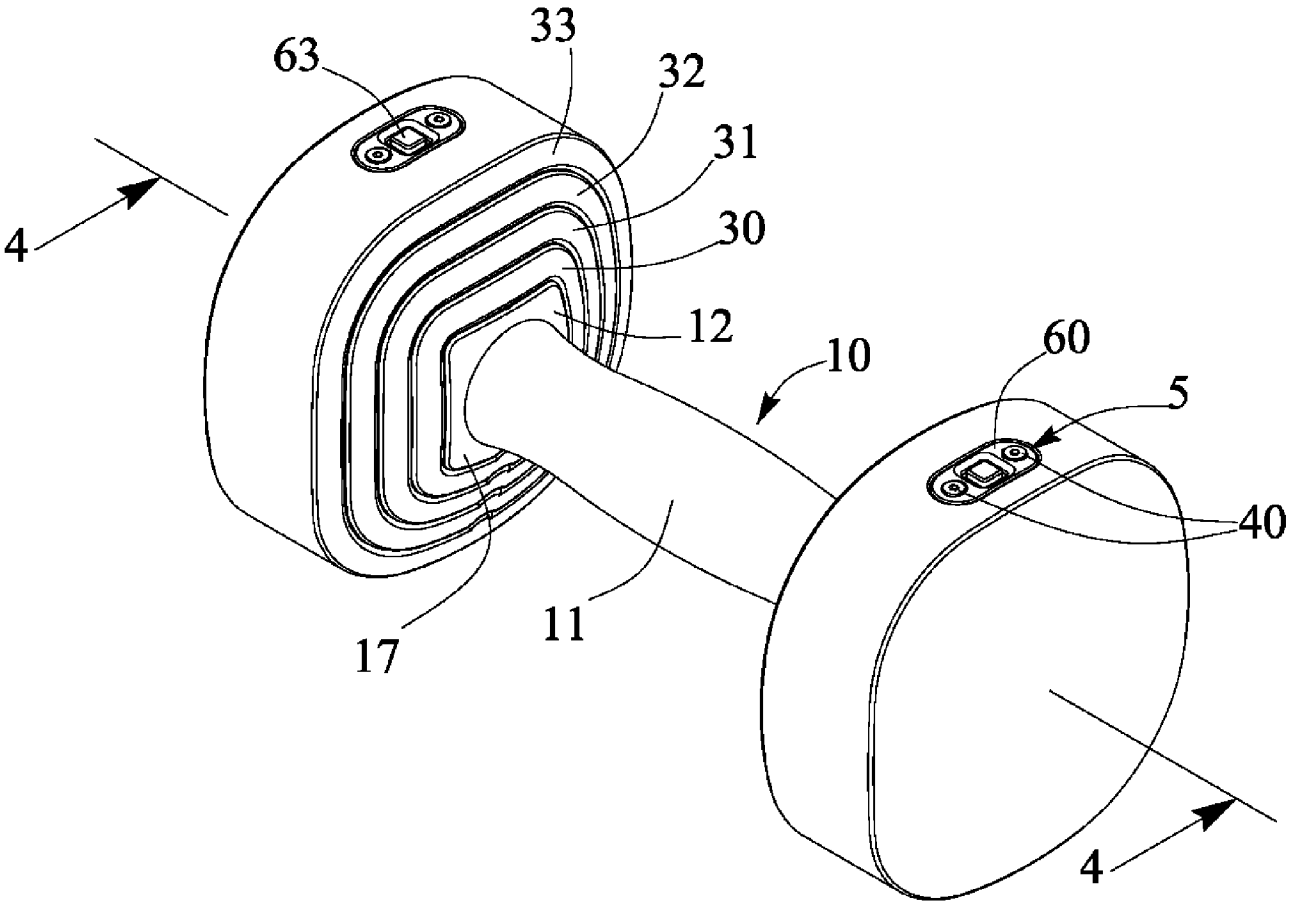
FIG. 1 is a perspective view of an adjustable exercise device or barbell or dumbbell in accordance with the present invention.
Figure 2:
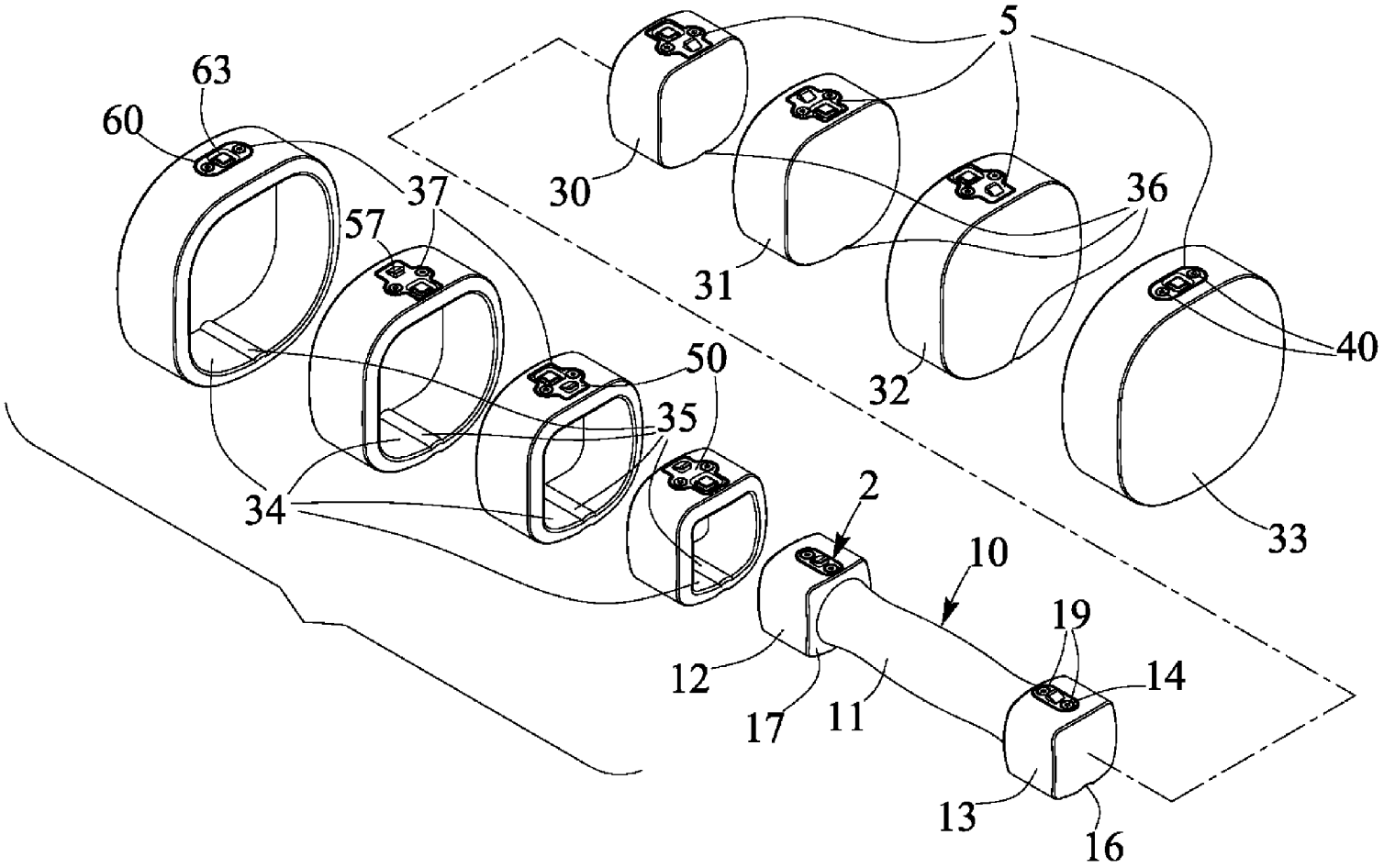
FIG. 2 is a partial exploded view of the adjustable dumbbell.

Referring to the drawings, and initially to FIGS. 1-4, an adjustable dumbbell or barbell or exercise device in accordance with the present invention comprises a longitudinal shaft or handle 10 including a hand grip 11 formed or provided on the middle or center portion thereof for being grasped or held by the user and for carrying or lifting or moving the handle 10 and for allowing the adjustable dumbbell to be easily operated by the user, and including two end plates or end portions or end members 12, 13, such as first and second end members 12, 13 each having a square, rectangular, or non-circular cross section, and each having a depression or compartment or recess 14 formed therein, such as formed in the upper portion thereof and opened upwardly, and each having a compartment or recess or depression or cavity 15 formed therein, such as also formed in the upper portion thereof and communicating with the respective recess 14 of the handle 10.

Figure 3:
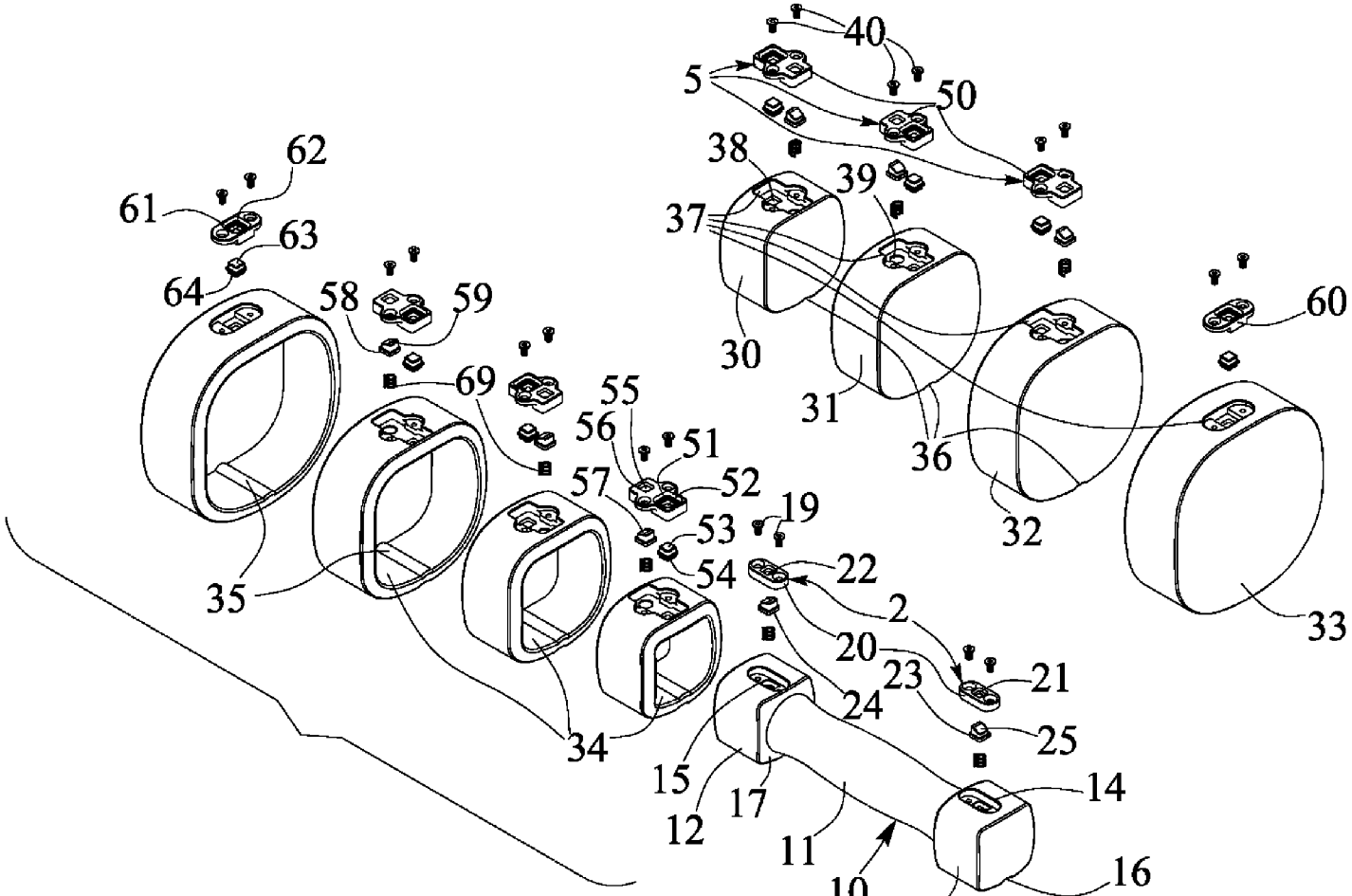
FIG. 3 is another partial exploded view of the adjustable dumbbell.

As best shown in FIG. 3, the cavity 15 of the handle 10 includes an area or length or width or dimension smaller than that of the recess 14 of the handle 10. The handle 10 further includes an engaging or anchoring device or member or element 16 formed therein, such as formed in the lower or bottom portion thereof, for example, the anchoring element 16 may be selected from a bulge or projection or protrusion or depression 16 formed in the lower or bottom portion thereof and located distal to or opposite to the cavity 15 and the recess 14 of the handle 10, and preferably directed or opened downwardly. It is preferable that the end members 12, 13 each include a height or width or dimension or outer diameter smaller or greater than that of the hand grip 11 for forming or defining a peripheral shoulder 17 between the hand grip 11 and the respective end member 12, 13 of the handle 10.

Two locking or latching devices 2 are provided and attached or mounted or secured to the end members 12, 13 of the handle 10 respectively, for example, the latching devices 2 each include a bar or panel or insert or plate 20 disposed or engaged into the recess 14 of the respective end member 12, 13 of the handle 10 and secured or anchored or retained to the respective end member 12, 13 of the handle 10 with latches or fasteners 19 respectively, and the plates 20 each include an orifice 21 formed therein for slidably receiving or engaging with a locking or latching element 23 therein, and each include an inner peripheral rib or flange 22 partially extended into the orifice 21 thereof, and the locking or latching element 23 also includes an outer peripheral flange or rib 24 extended radially and outwardly therefrom for selectively engaging with the peripheral flange 22 of the plate 20 (FIG. 5) and for limiting the latching element 23 to slide or move relative to the plate 20 and for preventing the latching element 23 from being disengaged from the plate 20 and the respective end member 12, 13 of the handle 10.

Figure 4:
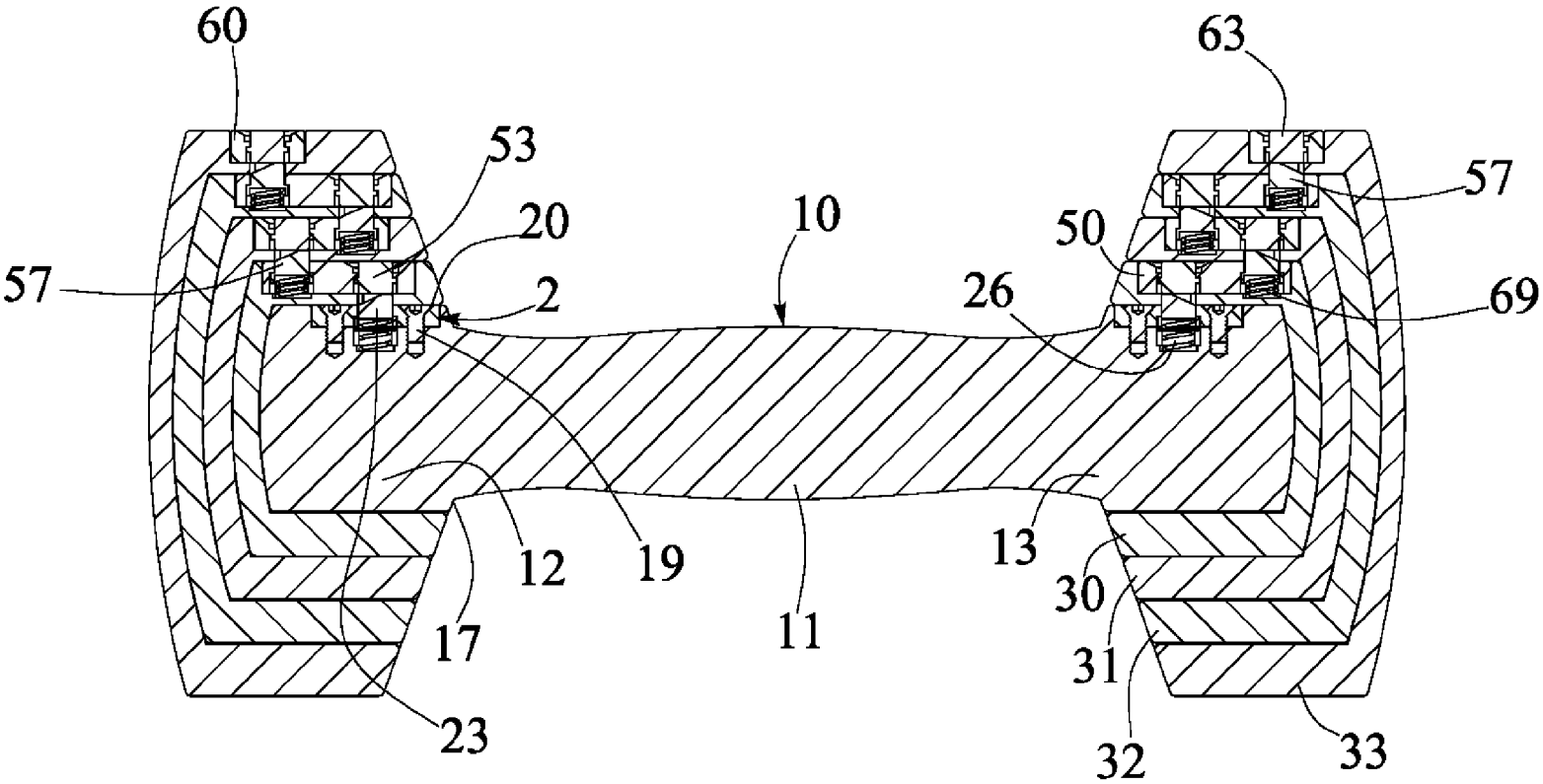
FIG. 4 is a cross sectional view of the adjustable dumbbell, taken along lines 4-4 of FIG. 1.
Figure 5:
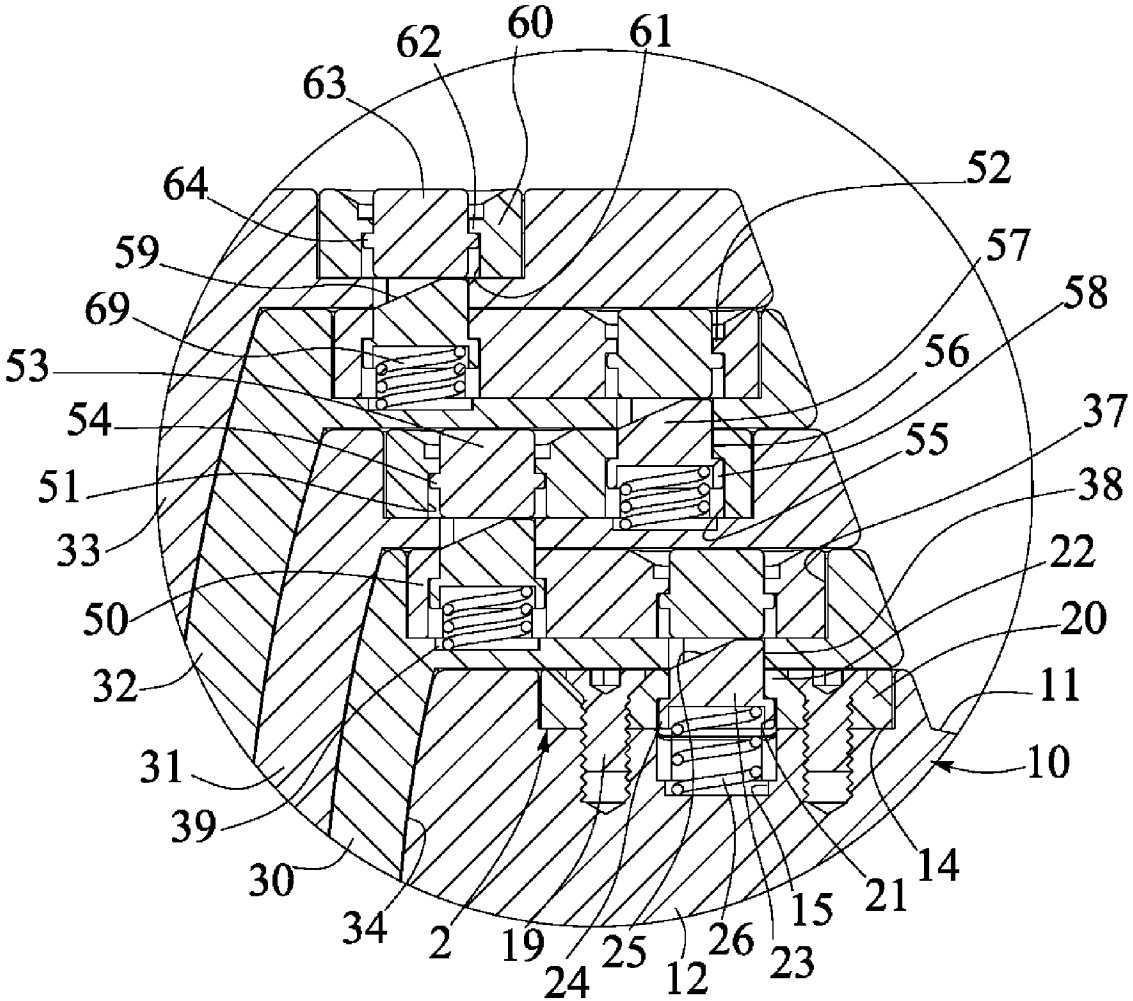
FIG. 5 is an enlarged partial cross sectional view of the adjustable dumbbell.
Figure 6:
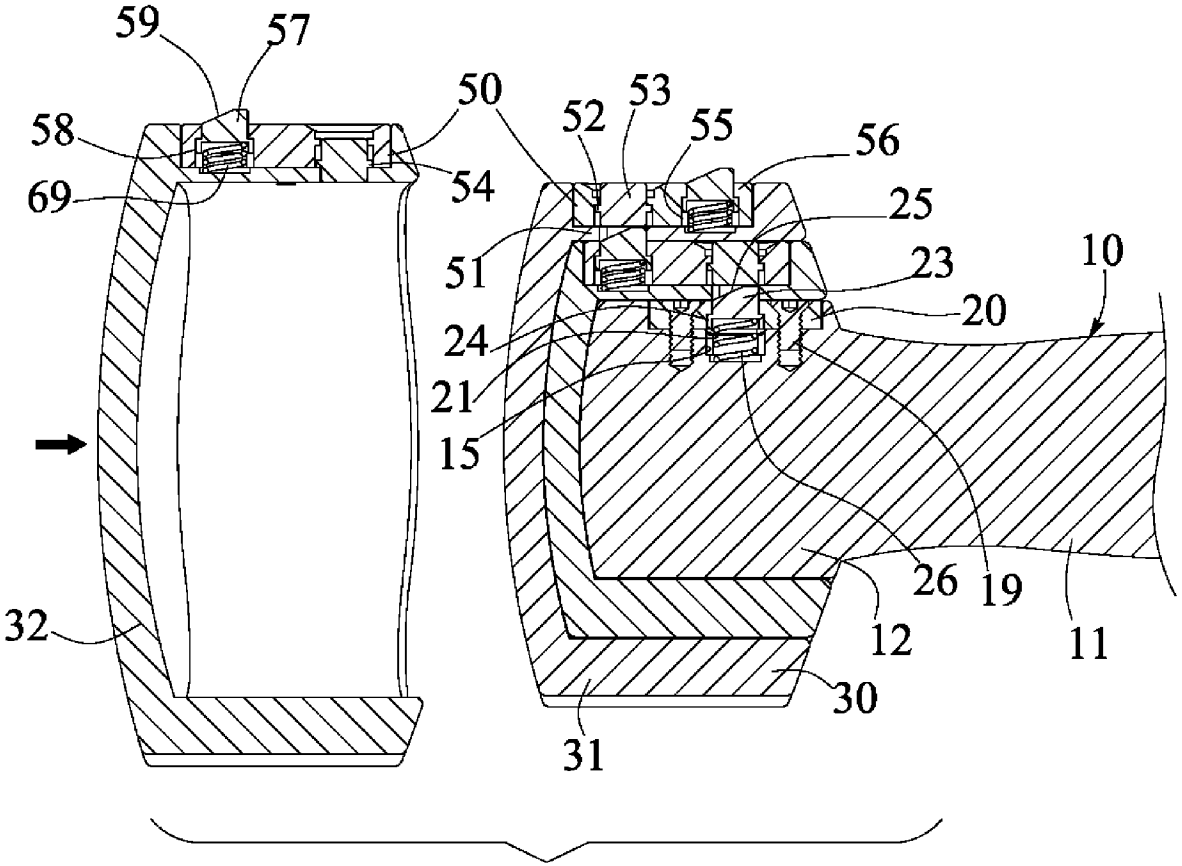
FIG. 6 is a partial exploded and cross sectional view illustrating the operation of the adjustable dumbbell.
Figure 8:
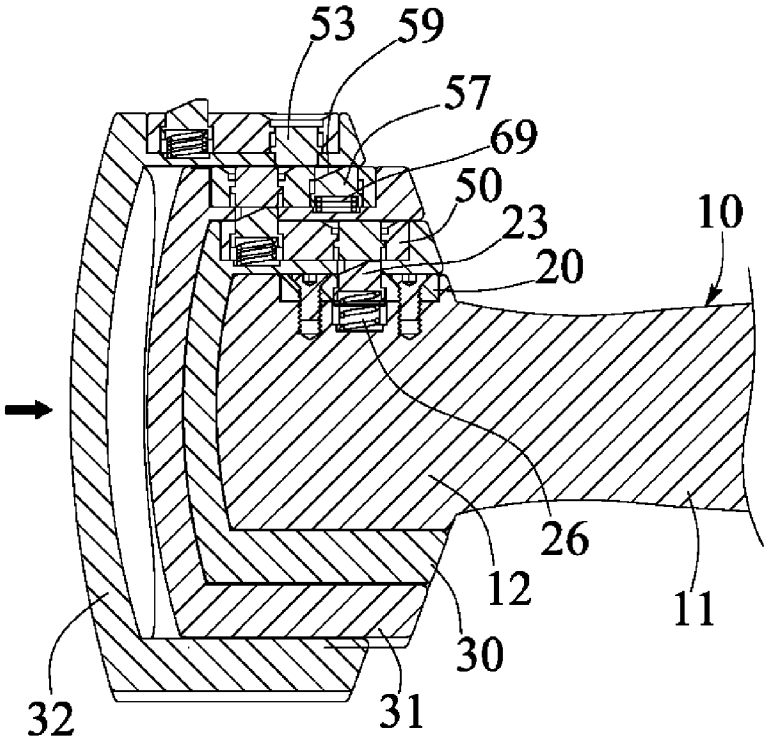
FIGS. 7, 8, 9, 10, 11 are partial cross sectional views illustrating the operation of the adjustable dumbbell.
Figure 7:
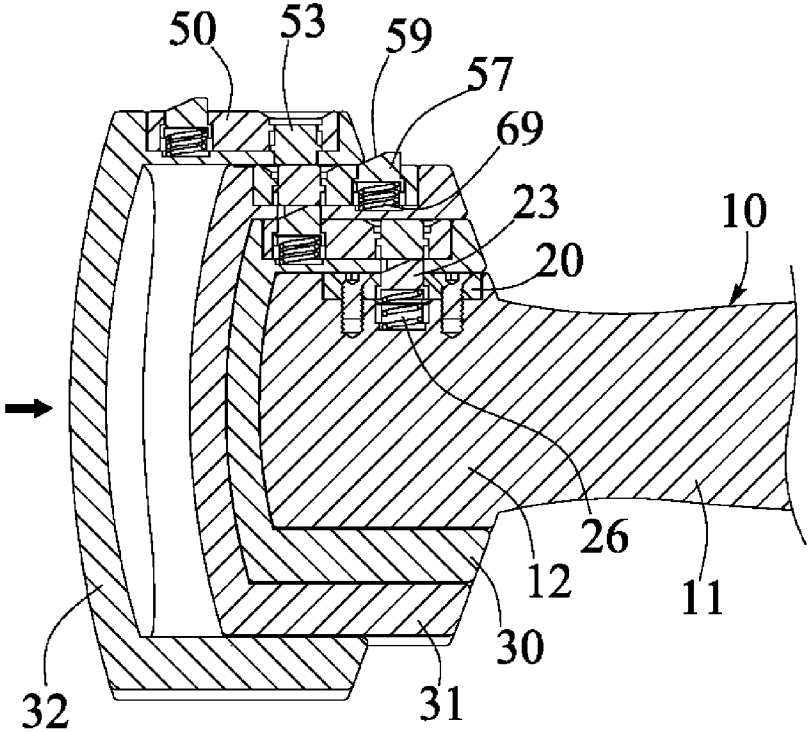

As best shown in FIGS. 3-5, the latching element 23 is slidable or movable relative to the plate 20 and partially extendible out of the plate 20 and/or the end member 12, 13 of the handle 10, and includes a tilted or inclined surface 25 formed or provided on top thereof, and includes a spring biasing member 26 disposed or engaged into the cavity 15 of the respective end member 12, 13 of the handle 10 and engaged with or between the latching element 23 and the respective end member 12, 13 of the handle 10 for biasing or moving or forcing the latching element 23 to partially extend out of the plate 20 and/or the end member 12, 13 of the handle 10, and/or for biasing or moving or forcing the tilted or inclined surface 25 of the latching element 23 to move out of the plate 20 and/or the end member 12, 13 of the handle 10, and arranged for allowing the latching element 23 to be selectively moved or depressed or compressed onto the spring biasing member 26 and into the orifice 21 of the plate 20.

The exercise device further comprises one or more weight plates or weight members 30, 31, 32, 33, such as smallest or inner or first or base weight members 30, one or more middle or intermediate or second weight members 31, 32, and greatest or outer or third weight members 33 to be selectively attached or mounted or secured onto the respective end member 12, 13 of the handle 10 in series, and the weight plates or weight members 30, 31, 32, 33 each include a chamber 34 formed therein and facing or directed or opened toward the respective end member 12, 13 of the handle 10, and each include another engaging or anchoring device or member or element 35 extended into the chamber 34 of the respective weight members 30-33, and each include a further engaging or anchoring device or member or element 36 formed in the lower or bottom portion thereof and located below the anchoring element 35 thereof and/or formed or defined by the anchoring element 35 thereof.

For example, the chambers 34 of the smallest or inner or first weight members 30 each include a height or width or dimension or inner diameter or area equal to or slightly greater than the height or width or dimension or outer diameter or area of the end member 12, 13 of the handle 10 for receiving or engaging with the end member 12, 13 and for allowing the smallest or inner or first weight members 30 to be attached or mounted or secured onto the end member 12, 13 of the handle 10 respectively. The engaging or anchoring devices or members or elements 35 of the smallest or inner or first weight members 30 are engaged with the anchoring depressions or elements 16 at the end members 12, 13 of the handle 10 for anchoring or positioning or retaining the weight members 30 to the end members 12, 13 of the handle 10 and for preventing the weight members 30 from moving relative to the end members 12, 13 of the handle 10.

The weight plates or weight members 30-33 each include a space or depression or cavity or compartment 37 formed therein (FIGS. 2-3), such as formed in the upper portion thereof for attaching or mounting or securing or receiving or engaging with a locking or catching device 5 therein respectively, and a compartment or cavity or space or depression or aperture 38 formed therein, such as also formed in the upper portion thereof and communicating with the respective compartment 37 thereof (FIGS. 3, 5) and also communicating with the chamber 34 thereof, and the smaller (except the smallest) weight members 30-32 each may further include a cavity or recess or space or depression 39 formed therein and also communicating with the respective compartment 37 thereof, and spaced or separated or offset from the aperture 38 thereof, but not communicating with the chamber 34 thereof.

When the smallest or inner or first weight members 30 are attached or mounted or secured onto the end member 12, 13 of the handle 10 respectively, the weight members 30 may be contacted or engaged with the tilted or inclined surfaces 25 of the latching elements 23 respectively and may move or depress or compress the respective latching elements 23 onto the spring biasing member 26 and into the orifice 21 of the plate 20 for allowing the weight members 30 to be attached or engaged onto the end members 12, 13 of the handle 10 respectively, and the latching elements 23 may then be biased or moved or forced to engage into the apertures 38 of the weight members 30 respectively when the latching elements 23 are aligned with the apertures 38 of the weight members 30 respectively, in order to solidly and stably catch or lock or latch the weight members 30 to the end members 12, 13 of the handle 10 respectively and to prevent the weight members 30 from being disengaged from the end members 12, 13 of the handle 10 respectively.

The locking or catching devices 5 are provided and attached or mounted or secured to the weight members 30 respectively, for example, the catching devices 5 each include a bar or insert or plate or panel 50 (for weight members 30-32), 60 (for weight member 33) disposed or engaged into the compartment 37 of the respective weight member 30-33 and secured or anchored or retained to the respective weight member 30-33 with latches or fasteners 40 respectively, and the panels 50, 60 each include a hole 51, 61 formed therein for slidably receiving or engaging with a button 53, 63 therein, and each include an inner peripheral rib or flange 52, 62 partially extended into the hole 51, 61 thereof, and the button 53, 63 also includes an outer peripheral flange or rib 54, 64 extended radially and outwardly therefrom for selectively engaging with the peripheral flange 52, 62 of the panel 50, 60 (FIG. 5) and for limiting the button 53, 63 to slide or move relative to the panel 50, 60 and for preventing the button 53, 63 from being disengaged from the panel 50, 60 and the respective weight member 30-33.

As best shown in FIGS. 3-5, the button 53, 63 is slidable or movable relative to the panel 50, 60 and prevented from being extending out of the panel 50, 60, and arranged for selectively aligning with the latching element 23 when the latching element 23 is biased or forced to engage into the aperture 38 of the respective weight member 30, and arranged for allowing the latching element 23 to be selectively moved or depressed or compressed onto the spring biasing member 26 and into the orifice 21 of the plate 20 with the button 53, 63, and thus for allowing the weight members 30 to be selectively moved onto or disengaged from the end members 12, 13 of the handle 10 respectively when the latching elements 23 are depressed or compressed into the orifices 21 of the plates 20 respectively.

The panels 50 for the weight members 30-32 each further include a passage 55 formed therein for slidably receiving or engaging with a locking or catching element 57 therein, and each include an inner peripheral rib or flange 56 partially extended into the passage 55 thereof, and the locking or catching element 57 also includes an outer peripheral flange or rib 58 extended radially and outwardly therefrom for selectively engaging with the peripheral flange 56 of the panel 50 (FIG. 5) and for limiting the catching element 57 to slide or move relative to the panel 50 and for preventing the catching element 57 from being disengaged from the panel 50 and the respective weight member 30-32. As best shown in FIGS. 3-5, the catching element 57 is slidable or movable relative to the panel 50 and partially extendible out of the panel 50 and/or the weight members 30-32, and includes a tilted or inclined surface 59 formed or provided on top thereof for selectively engaging with the other weight members 31-33.

The catching devices 5 each further include a spring biasing member 69 disposed or engaged into the depression 39 of the respective weight member 30-32 and engaged with or between the catching element 57 and the respective weight member 30-32 for biasing or moving or forcing the catching element 57 to partially extend out of the panel 50 and/or the weight member 30-32, and/or for biasing or moving or forcing the tilted or inclined surface 59 of the catching element 57 to move out of the panel 50 and/or the weight member 30-32, and arranged for allowing the catching element 57 to be selectively moved or depressed or compressed onto the spring biasing member 69 and into the passage 55 of the panel 50 with the other weight members 31-33 when the other weight members 31-33 are engaged onto the smaller weight members 30-32 respectively.

For example, when the other or relatively greater weight members 31-33 are attached or mounted or secured onto the relatively smaller weight members 30-32 respectively (FIGS. 6-9), the weight member 31-33 may be contacted or engaged with the tilted or inclined surfaces 59 of the catching element 57 respectively and may move or depress or compress the respective catching element 57 onto the spring biasing member 69 and into the passage 55 of the panel 50 for allowing the relatively greater weight member 31-33 to be attached or engaged onto the relatively smaller weight member 30-32 respectively, and the catching elements 57 may then be biased or moved or forced to engage into the apertures 38 of the weight members 30-32 respectively when the catching elements 57 are aligned with the apertures 38 of the weight members 30-32 respectively, in order to solidly and stably catch or lock or latch the relatively greater weight members 31-33 to the relatively smaller weight members 30-32 respectively and to prevent the relatively greater weight members 31-33 from being disengaged from the relatively smaller weight members 30-32 respectively.

Figure 10:
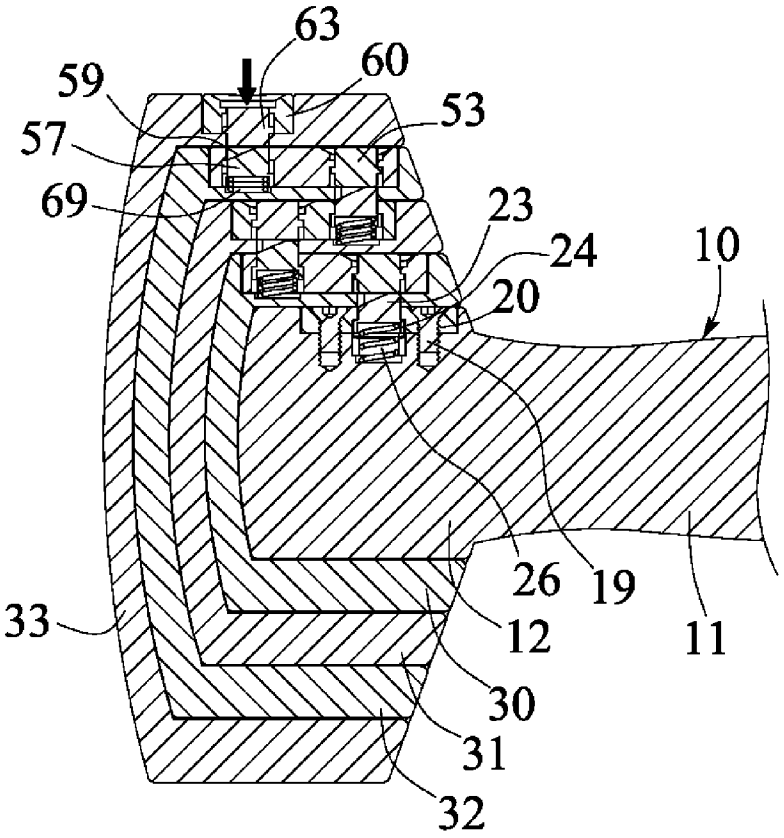
Figure 9:
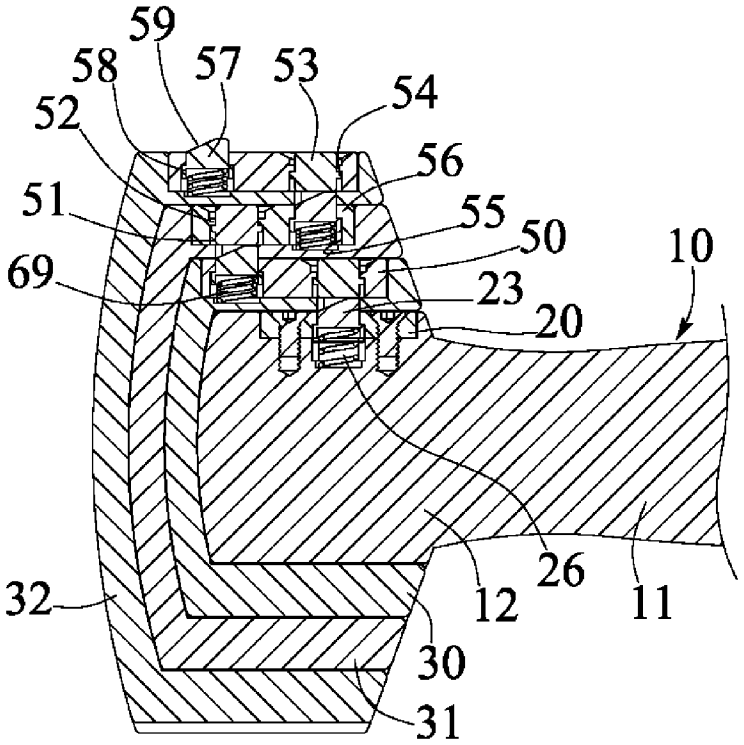
Figure 11:
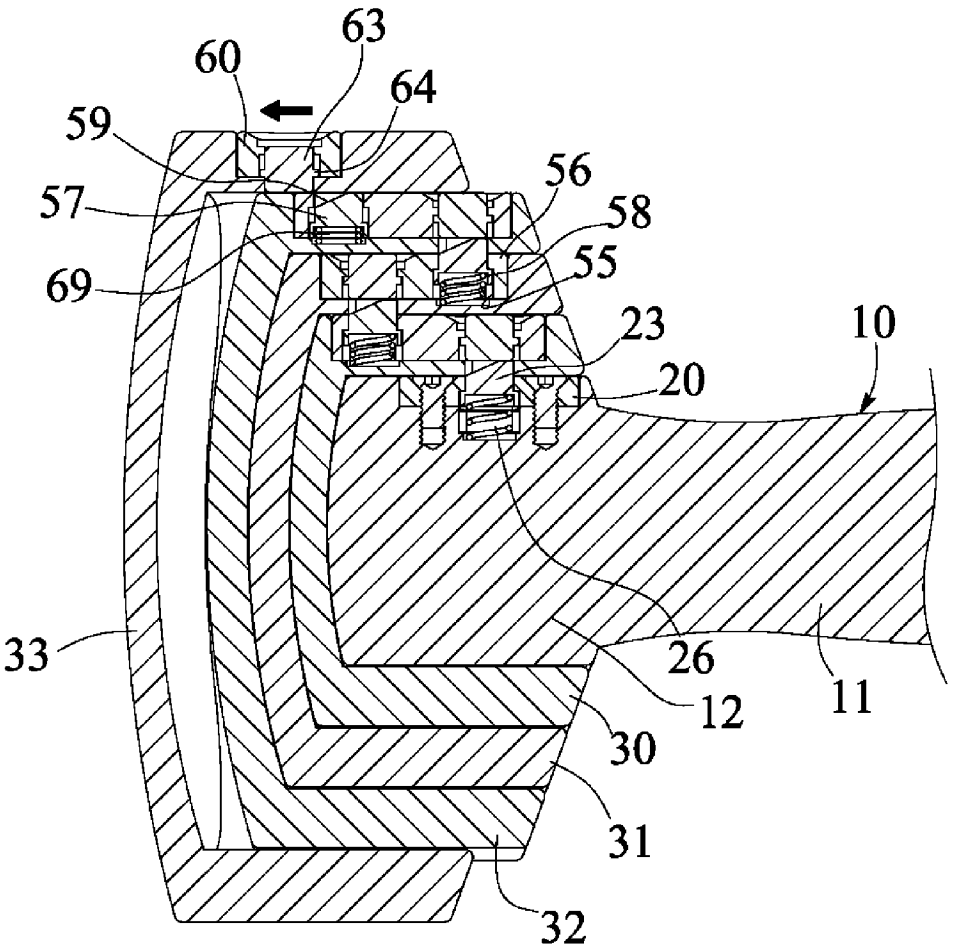
Figure 12:
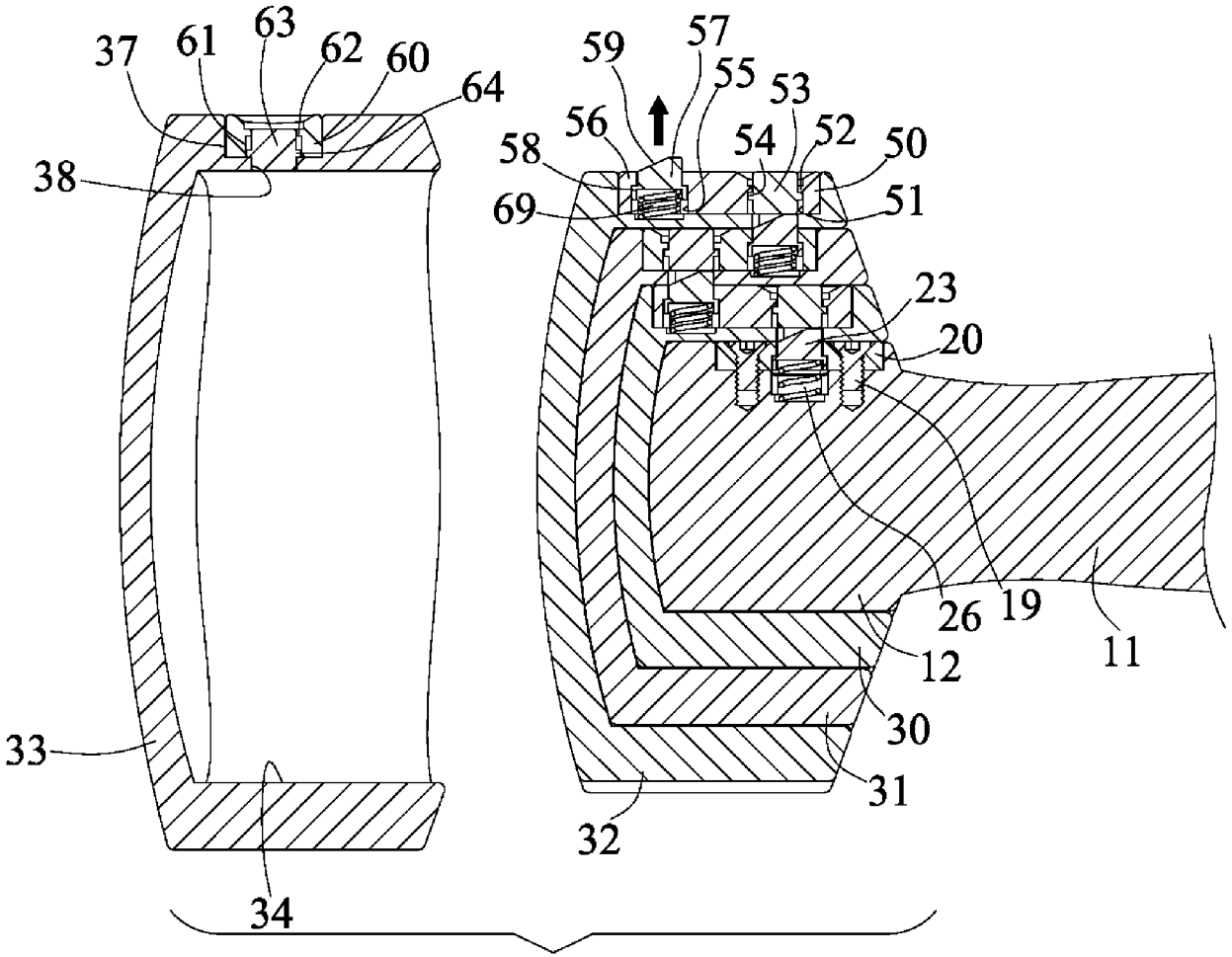
FIG. 12 is a further partial exploded and cross sectional view similar to FIG. 6, illustrating the operation of the adjustable dumbbell.

When the buttons 53, 63 of the relatively greater weight members 31-33 are aligned with the catching element 57 and when the catching element 57 is depressed or compressed into the passage 55 of the panel 50 with the button 53, 63 (FIG. 10) and separated or offset or disengaged from the aperture 38 of the respective weight member 31-33 (FIG. 11) for allowing the relatively greater weight members 31-33 to be moved relative to the relatively smaller weight members 30-32 respectively and to be separated or disengaged from the relatively smaller weight members 30-32 respectively (FIG. 12) when required. It is to be noted that the smallest or inner or first weight members 30 may be solidly and stably attached or mounted or secured or locked to the end members 12, 13 of the handle 10 respectively with the latching elements 23, and the relatively greater weight members 31-33 may be solidly and stably attached or mounted or secured or locked to the relatively smaller weight members 30-32 respectively with the catching elements 57. No supporting bases are required to be provided for supporting the weight plates or weight members 30-33 in place when coupling the weight plates or weight members 30-33 together.

As shown in FIGS. 4-5, the buttons 53 of the inner weight members 30 are required to be aligned with the latching elements 23 of the end members 12, 13 of the handle 10, and the catching elements 57 of the inner weight members 30 are required to be spaced or separated or offset from the buttons 53 of the inner weight members 30 and thus will also be spaced or separated or offset from the latching elements 23. The buttons 53 of the intermediate weight members 31 are required to be aligned with the catching elements 57 of the inner weight members 30 for selectively moving or depressing or compressing the catching elements 57 of the inner weight members 30 onto the spring biasing members 69 and into the passage 55 of the panel 50 of the inner weight members 30. The catching elements 57 of the intermediate weight members 31 are required to be spaced or separated or offset from the buttons 53 of the intermediate weight members 31 and thus will also be spaced or separated or offset from the catching elements 57 of the inner weight members 30. Similarly, the buttons 53 of the outer intermediate weight members 32 are aligned with the catching elements 57 of the intermediate weight members 31, and spaced from the catching elements 57 of the outer intermediate weight members 32.

Accordingly, the adjustable exercise device or dumbbell in accordance with the present invention includes an improved compact structure for allowing the weight members to be easily and quickly and readily and adjustably attached to or disengaged from the weight carrier or handle and for allowing the adjustable dumbbell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a handle including a first end member, said handle including a recess formed in said first end member, a first spring biased latching element slidably received and engaged in said first end member of said handle, and selectively extendible out of said first end member of said handle, and including an inclined surface formed and provided on top thereof, a plate engaged into said recess of said first end member, said plate including an orifice formed therein for slidably receiving and engaging with said first spring biased latching element, a first base weight member including a chamber formed therein for receiving and engaging with said first end member of said handle and for allowing said first base weight member to be attached and engaged onto said first end member of said handle, and including an aperture formed in said first base weight member and communicating with said chamber of said first base weight member, and said first base weight member being contactable and engageble with said inclined surface of said first spring biased latching element for pressing said first spring biased latching element into said first end member of said handle and for allowing said first base weight member to be attached and engaged onto said first end member of said handle, and said first spring biased latching element being biased to engage into said aperture of said first base weight member when said first spring biased latching element is aligned with said aperture of said first base weight member, for anchoring and retaining said first base weight member to said first end member of said handle, and a first button slidably received and engaged in said first base weight member and aligned with said aperture of said first base weight member and said first spring biased latching element for selectively depressing said first spring biased latching element into said first end member of said handle, and for selectively disengaging said first spring biased latching element from said first base weight member and for allowing said first base weight member to be engaged onto and disengaged from said first end member of said handle.

2. The adjustable exercise device as claimed in claim 1, wherein said plate includes a flange extended into said orifice of said plate, and said first spring biased latching element includes an outer peripheral rib for selectively engaging with said flange of said plate and for limiting said first spring biased latching element to slide and move relative to said plate and for preventing said first spring biased latching element from being disengaged from said plate and said first end member of said handle.

3. The adjustable exercise device as claimed in claim 1, wherein said handle includes a cavity formed in said first end member for receiving and engaging with a spring biasing member of said first spring biased latching element.

4. The adjustable exercise device as claimed in claim 1, wherein said handle includes a second end member, a second spring biased latching element slidably received and engaged in said second end member of said handle, and selectively extendible out of said second end member of said handle, and an inclined surface formed and provided on top of said second spring biased latching element, a second base weight member having a chamber formed therein for receiving and engaging with said second end member of said handle and for allowing said second base weight member to be attached and engaged onto said second end member of said handle, and having an aperture formed in said second base weight member and communicating with said chamber of said second base weight member, and said second base weight member is contactable and engageble with said inclined surface of said second spring biased latching element for pressing said second spring biased latching element into said second end member of said handle and for allowing said second base weight member to be attached and engaged onto said second end member of said handle, and said second spring biased latching element being biased to engage into said aperture of said second base weight member when said second spring biased latching element is aligned with said aperture of said second base weight member, for anchoring and retaining said second base weight member to said second end member of said handle, and a second button slidably received and engaged in said second base weight member and aligned with said aperture of said second base weight member and said second spring biased latching element for selectively depressing said second spring biased latching element into said second end member of said handle, and for selectively disengaging said second spring biased latching element from said second base weight member and for allowing said second base weight member to be engaged onto and disengaged from said second end member of said handle.

5. An adjustable exercise device comprising:

a handle including a first end member, a first spring biased latching element slidably received and engaged in said first end member of said handle, and selectively extendible out of said first end member of said handle, and including an inclined surface formed and provided on top thereof, a first base weight member including a chamber formed therein for receiving and engaging with said first end member of said handle and for allowing said first base weight member to be attached and engaged onto said first end member of said handle, and including an aperture formed in said first base weight member and communicating with said chamber of said first base weight member, and said first base weight member being contactable and engageble with said inclined surface of said first spring biased latching element for pressing said first spring biased latching element into said first end member of said handle and for allowing said first base weight member to be attached and engaged onto said first end member of said handle, and said first spring biased latching element being biased to engage into said aperture of said first base weight member when said first spring biased latching element is aligned with said aperture of said first base weight member, for anchoring and retaining said first base weight member to said first end member of said handle, and a first button slidably received and engaged in said first base weight member and aligned with said aperture of said first base weight member and said first spring biased latching element for selectively depressing said first spring biased latching element into said first end member of said handle, and for selectively disengaging said first spring biased latching element from said first base weight member and for allowing said first base weight member to be engaged onto and disengaged from said first end member of said handle, said handle including a recess formed in said second end member, and a plate engaged into said recess of said second end member, and said plate includes an orifice formed therein for slidably receiving and engaging with said second spring biased latching element.

6. The adjustable exercise device as claimed in claim 5, wherein said plate includes a flange extended into said orifice of said plate, and said second spring biased latching element includes an outer peripheral rib for selectively engaging with said flange of said plate and for limiting said second spring biased latching element to slide and move relative to said plate and for preventing said second spring biased latching element from being disengaged from said plate and said second end member of said handle.

7. The adjustable exercise device as claimed in claim 5, wherein said handle includes a cavity formed in said second end member for receiving and engaging with a spring biasing member of said second spring biased latching element.

8. An adjustable exercise device comprising:

a handle including a first end member, a first spring biased latching element slidably received and engaged in said first end member of said handle, and selectively extendible out of said first end member of said handle, and including an inclined surface formed and provided on top thereof, a first base weight member including a chamber formed therein for receiving and engaging with said first end member of said handle and for allowing said first base weight member to be attached and engaged onto said first end member of said handle, and including an aperture formed in said first base weight member and communicating with said chamber of said first base weight member, and said first base weight member being contactable and engageble with said inclined surface of said first spring biased latching element for pressing said first spring biased latching element into said first end member of said handle and for allowing said first base weight member to be attached and engaged onto said first end member of said handle, and said first spring biased latching element being biased to engage into said aperture of said first base weight member when said first spring biased latching element is aligned with said aperture of said first base weight member, for anchoring and retaining said first base weight member to said first end member of said handle, and a first button slidably received and engaged in said first base weight member and aligned with said aperture of said first base weight member and said first spring biased latching element for selectively depressing said first spring biased latching element into said first end member of said handle, and for selectively disengaging said first spring biased latching element from said first base weight member and for allowing said first base weight member to be engaged onto and disengaged from said first end member of said handle, said first base weight member including a first spring biased catching element slidably received and engaged in said first base weight member, and selectively extendible out of said first base weight member, and including an inclined surface formed and provided on top of said first spring biased catching element, an intermediate weight member including a chamber formed therein for receiving and engaging with said first base weight member and for allowing said intermediate weight member to be attached and engaged onto said first base weight member, and including an aperture formed in said intermediate weight member and communicating with said chamber of said intermediate weight member, and said intermediate weight member being contactable and engageble with said inclined surface of said first spring biased catching element for pressing said first spring biased catching element into said first base weight member and for allowing said intermediate weight member to be attached and engaged onto said first base weight member, and said first spring biased catching element being biased to engage into said aperture of said intermediate weight member when said first spring biased catching element is aligned with said aperture of said intermediate weight member for anchoring and retaining said intermediate weight member to said first base weight member.

9. The adjustable exercise device as claimed in claim 8, wherein said intermediate weight member includes a second button slidably received and engaged in said intermediate weight member and aligned with said aperture of said intermediate weight member and said first spring biased catching element for selectively depressing said first spring biased catching element into said first base weight member, and for selectively disengaging said first spring biased catching element from said intermediate weight member and for allowing said intermediate weight member to be engaged onto and disengaged from said first base weight member.

10. The adjustable exercise device as claimed in claim 9, wherein said intermediate weight member includes a compartment formed therein, a panel engaged into said compartment of said intermediate weight member and having a hole formed therein for slidably receiving and engaging with said second button.

11. The adjustable exercise device as claimed in claim 10, wherein said panel includes an inner peripheral flange extended into said hole thereof, and said second button includes an outer peripheral rib for selectively engaging with said peripheral flange said panel and for limiting said second button to slide and move relative to said panel and for preventing said second button from being disengaged from said panel and said intermediate weight member.

12. The adjustable exercise device as claimed in claim 8, wherein said intermediate weight member includes a second spring biased catching element slidably received and engaged in said intermediate weight member, and selectively extendible out of said intermediate weight member, and includes an inclined surface formed and provided on top of said second spring biased catching element, an outer weight member includes a chamber formed therein for receiving and engaging with said intermediate weight member and for allowing said outer weight member to be attached and engaged onto said intermediate weight member, and includes an aperture formed in said outer weight member and communicating with said chamber of said outer weight member, and said outer weight member is contactable and engageble with said inclined surface of said second spring biased catching element for pressing said second spring biased catching element into said intermediate weight member and for allowing said outer weight member to be attached and engaged onto said intermediate weight member, and said second spring biased catching element is biased to engage into said aperture of said outer weight member when said second spring biased catching element is aligned with said aperture of said outer weight member for anchoring and retaining said outer weight member to said intermediate weight member.

13. The adjustable exercise device as claimed in claim 12, wherein said outer weight member includes a third button slidably received and engaged in said outer weight member and aligned with said aperture of said outer weight member and said second spring biased catching element for selectively depressing said second spring biased catching element into said intermediate weight member, and for selectively disengaging said second spring biased catching element from said outer weight member and for allowing said outer weight member to be engaged onto and disengaged from said intermediate weight member.

14. The adjustable exercise device as claimed in claim 13, wherein said outer weight member includes a compartment formed therein, a panel engaged into said compartment of said outer weight member and having a hole for engaging with said third button.

15. The adjustable exercise device as claimed in claim 14, wherein said panel includes an inner peripheral flange extended into said hole thereof, and said third button includes an outer peripheral rib for selectively engaging with said peripheral flange said panel and for limiting said third button to slide and move relative to said panel.

* * * * *